United States Patent [19]

Gubbe et al.

[11] 4,379,429

[45] Apr. 12, 1983

[54] HEIGHT AND INCLINATION ADJUSTABLE SUPPORT SHELF

[75] Inventors: Bernd Gubbe, Nuremberg; Klaus-Dieter Krause, Oberasbach; Rudolf Neidhardt, Nuremberg; Otto Schonemann, Furth, all of Fed. Rep. of Germany

[73] Assignee: Triumph-Adler A.G., Nuremberg, Fed. Rep. of Germany

[21] Appl. No.: 231,459

[22] Filed: Feb. 4, 1981

[30] Foreign Application Priority Data

Apr. 15, 1980 [DE] Fed. Rep. of Germany ..... 3014276

[51] Int. Cl.[3] ..... A47B 21/02; A47B 21/03

[52] U.S. Cl. ..... 108/5; 108/138; 108/143

[58] Field of Search ..... 108/5, 4, 143, 138, 108/102

[56] References Cited

U.S. PATENT DOCUMENTS

| | | | |
|---|---|---|---|
| 206,378 | 7/1878 | Wilber | 108/5 |
| 614,666 | 11/1898 | Petry | 297/431 |
| 668,038 | 2/1901 | Duhamel | 108/4 |
| 1,188,792 | 6/1916 | Kormendy | 108/5 |
| 2,689,157 | 9/1954 | DiCenso | 108/5 |
| 2,946,638 | 7/1960 | Colo | 108/143 |
| 3,516,369 | 6/1970 | Bidak et al. | 108/138 |

*Primary Examiner*—Francis K. Zugel

*Attorney, Agent, or Firm*—Joseph R. Spalla

[57] ABSTRACT

A pullout shelf provided with rollers is mounted on static roller guide structure having several tracks with openings in the tracks to allow manipulation of the shelf and a supported machine to desired heights and inclinations.

2 Claims, 5 Drawing Figures

HEIGHT AND INCLINATION ADJUSTABLE SUPPORT SHELF

This invention relates to pullout shelves; more particularly it relates to static guide means for pullout shelves having several horizontal tracks with openings therebetween to permit track switching of shelf mounted rollers to different horizontal levels and to different inclinations relative to a horizontal plane by manipulation of the shelf.

Pullout shelves for supporting a business machine for guided movement from a storage position within a cabinet to a position for operation are known to the art. However, pullout shelves of the prior art are not usually provided with guiding means to facilitate adjustment of height and/or inclination without undue complexity and expense. In work stations wherein the output of a keyboard is displayed on the face of a cathode ray tube separate from the keyboard, the adjustment of the keyboard height and inclination relative to the display unit mounted, for example, on the top of a table, is of particular importance to minimize operator fatique.

In accordance with the invention there is provided static guide means mounted below a table top supporting a display unit having several horizontal tracks for guiding two pairs of spaced rollers on a pullout shelf supporting, for example, a keyboard. The shelf rollers are switchable from track to track through openings in the tracks by manipulation of the shelf about the axes of the pairs of rollers to adjust both height and inclination of the shelf.

An object of the invention is in the provision of static guide means to permit a pullout shelf supported for movement in guide means to be adjusted to different horizontal levels and to different inclinations to the horizontal.

Another object of the invention is in the provision of at least two horizontal vertically spaced tracks with openings between tracks, and pairs of rollers on a shelf which can be switched from track to track by manipulation of the shelf about the axes of the pairs of rollers.

Other objects, features and advantages of the present invention will become known to those skilled in the art from a reading of the following detailed description when taken in conjuction with the accompanying drawing wherein like reference numerals designate like or corresponding parts throughout the several views thereof, and wherein.

Figure 1:
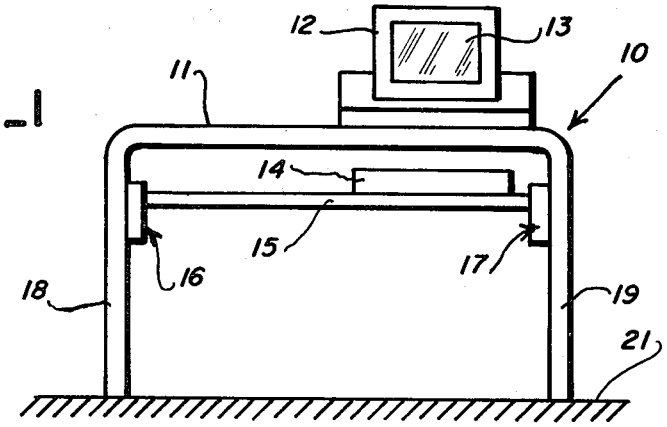
FIG. 1 is a front elevational view of a table with a pull-out shelf.

Referring now to the drawing wherein like reference numerals designate like or corresponding elements throughout the several views there is shown in FIG. 1 a work station comprising a table generally designated by reference 10 having a horizontal platform on whose top surface 11 a CRT unit 12 is mounted for displaying on its face or screen 13 information keyed into a keyboard 14 by an operator sitting in front of the screen 13. As shown in FIG. 1 the keyboard 14 is supported on a pullout shelf 15 horizontally disposed below the top surface 11 of the table 10. The shelf 15 is supported and guided for pull-out push-in movement, and for adjustment to different heights I–III (FIG. 2), and to different inclinations IV–VI (FIG. 3), by left and right handed guide means, generally designated by reference numerals 16 and 17, which are secured opposite one another to the inside of the left and right legs 18 and 19 supporting the table 10 on a horizontal reference plane 21.

Figure 2:
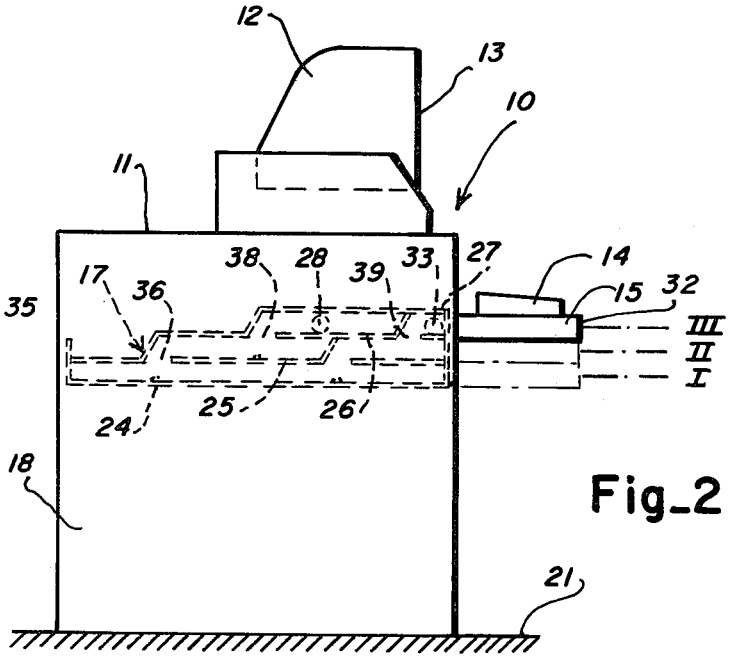
FIG. 2 is a side elevational view of the table shown in FIG. 1 with the pull-out shelf in operative pulled out position illustrating adjustment to different vertical heights.
Figure 4:
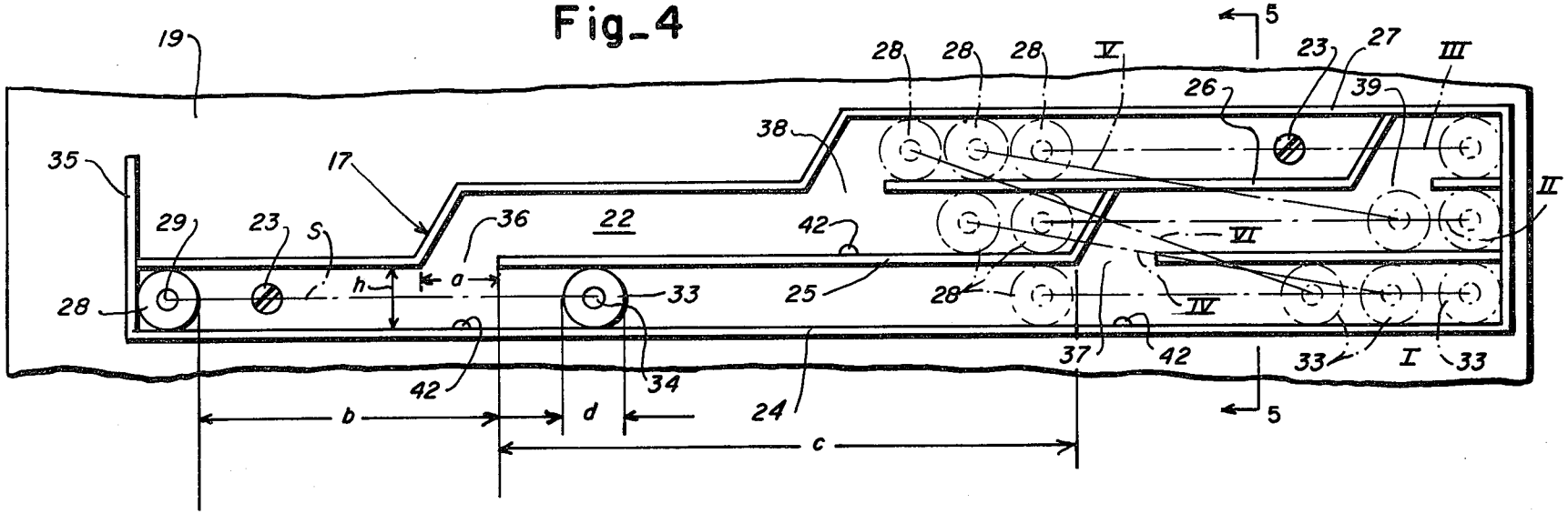
FIG. 4 is a cross sectional view taken along lines 4—4 of FIG. 1 showing the shelf guide structure according to the invention.

The left and right guide means 16 and 17 which are mirror images of one another are each formed as a unit and comprise with reference to FIG. 2 and in particular to FIG. 4, a vertical support wall 22 secured as by screws 23 to the inside of the legs 18 and 19 of the table 10. Extending horizontally and inwardly from the vertical wall 22, and equally vertically spaced from one another, are a lower continuous guide track 24, a discontinuous or interrupted middle guide track 25, a discontinuous or interrupted upper guide track 26 and an upper boundary wall 27.

Figure 5:
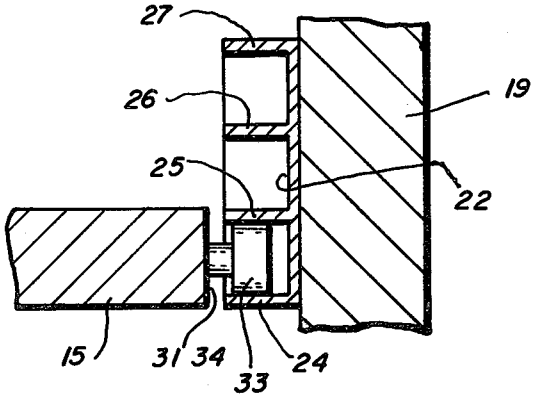
FIG. 5 is a fragmentary cross sectional view taken along lines 5—5 of FIG. 4 showing guide details.

The tracks 24, 25 and 26 are adapted to guide and support, at any of the positions I–VI the pull-out shelf 15. To this end the shelf 15 carries a rearwardly located pair of rollers 28 rotatably mounted on axially aligned pins 29 mounted in and extending laterally from the left and right sides 31 of the shelf 15. Similarly, and spaced forwardly or toward the front edge 32 of the shelf is another pair of rollers 33 rotatably mounted on pins 34 as shown in FIG. 5.

The full line position of the spaced pairs of rollers 28 and 33, on track 24, shown in FIG. 4 with the rear pair of rollers 28 against a rear wall 35 of the guide means 16 and 17, corresponds to the pushed in storage position S of the shelf in the embodiment shown. As will be noted from FIGS. 4 and 5, the spacing h between tracks is only slightly greater than the diameter d of the rollers 28 and 33 to provide smooth guidance with negligible play.

As shown in FIG. 4 the middle track 25 has two rear to front spaced cut outs or switch openings 36 and 37 and upper track 26 has two cutouts or switch openings 38 and 39. The lengths, a, of these openings are slightly greater than the diameter, d, of the rollers 28, 33, on the order of 1 to 5 millimeters greater. This allows the shelf 15, when the rear pair of rollers 28 are positioned above or below openings 36 or 38, for example, to be pivoted about the front pair of rollers 33 to switch the rear pair of rollers 28 from lower track 24 to middle track 25 and from middle track 25 to upper track 26.

The spacing or distance b between the pairs of rollers 28 and 33 is less than the spacing or distance c between openings 36 and 37 and 38 and 39 to preclude simultaneous alignment of both pairs of rollers 28 and 33 with front and back openings in a track. Further, the openings 36, 37 in the middle track 25 are staggered relative to the openings 38, 39 in the upper track 26, i.e. the opeings 38 and 39 in upper track 26 are displaced toward the front relative to the openings 36 and 37 in middle track 25 to prevent the pair of rollers 28 or 33 from dropping through two tracks, e.g. from track 26 to track 24.

Assuming the shelf 15 is in storage position S beneath the table 10 supported on track 25, to establish position I shown in FIG. 2 only requires the shelf 15 to be pulled out until the front pair of rollers 33 reach the pull-out limit defined by the front wall 41 of the guide means 16 and 17. To move the shelf 15 to position II of FIG. 2, as for example, from the storage position S, the shelf 15 will be partially pulled out until the rear pair of rollers 28 is opposite the openings 36 in middle tracks 25. This position is signalled to an operator when rollers 28 encounter a rounded protuberance 42 on lower track 24 below the openings 36 in middle tracks 25. At this intermediate position the front end 32 of shelf 15 is lowered and pivots about the front pair of rollers 33, lifting the rear pair of rollers 28 through the rear openings 36 in middle tracks 25, following which the shelf 15 is drawn further toward the front until the front pair of rollers 33 encounter a second protuberance 42 below the front openings 37 in middle track 25 at which time the front end of the shelf 15 is raised and pivots about the rear pair of rollers 28 now riding on middle track 25 bringing the front pair of rollers 33 up into middle track 25 at which time the shelf 15 is pulled to the front pull-out limit establishing position II (FIG. 2). Movement to position III (FIG. 2) is accomplished in similar fashion by aligning and moving through the rear and front openings 38 and 39 in upper track 26.

Figure 3:
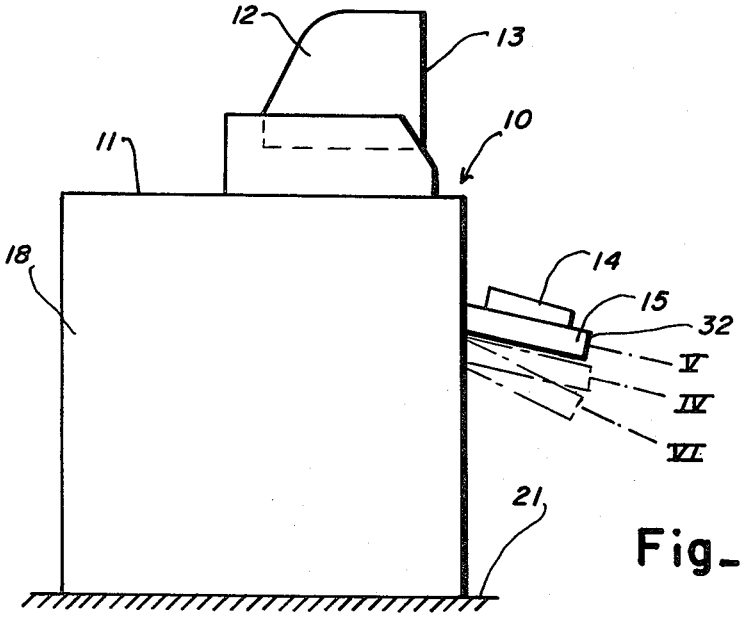
FIG. 3 is a view similar to FIG. 2 illustrating the adjustment of the pull-out shelf to different inclinations from the horizontal.

If inclined position IV (FIG. 3) is desired the shelf 15 is pulled, for example, from the storage position S to again bring the rear pair of roller 28 below the rear openings 36 in middle track 25 following which the front end 32 of the shelf 15 is again lowered causing the shelf 15 to pivot about the front pair of rollers 33 thereby to lift rear pair of rollers 28 into middle track 25. Following this the shelf 15 is pulled toward the front to establish position IV (FIG. 3) with the rear pair of rollers 28 in middle track 25 and the front pair of rollers 33 in lower track 24. Similarly the shelf 15 may be manipulated to position the rear pair of rollers 28 on upper track 26 and the front pair of rollers 33 to middle track 25 to define inclined position V (FIG. 3), and to position the rear pair of rollers 28 on upper track 26 with the front pair of rollers 33 on lower track 24 to define position VI (FIG. 3). The various positions I–VI are shown in FIG. 4 in dotted outlines. It is to be understood that by proper manipulation the shelf may be moved to a desired position from any existing position. It should also be understood that reverse inclinations of the shelf 15 with its front end 32 higher than its rear edge is also possible.

As will be appreciated if the shelf 15 on upper track 26 were to be pushed beneath the table 10 from position III in FIG. 2, sufficient space between the underside of the table platform would be required to accommodate the height of the keyboard 14.

To enable the guide means 16 and 17 to be more closely spaced beneath the table top 11, the guide means 16 and 17 are formed to direct the shelf to the storage position S on lower track 24. To this end, rearwardly of the openings 38 and 39 in upper track 26, and rearwardly of the openings 36 and 37 in middle track 25, the guide means are formed with downwardly and rearwardly directed inclines 43 located in the path of the pairs of rollers 28 and 33 thereby to downwardly guide the pairs of rollers 28 and 33 riding on the upper and middle tracks 26 and 25, towards lower track 24. Thus when the shelf 15 is pushed in from any position it will be returned to storage position S on lower track 24.

This return to storage position feature eliminates the need to extend the upper boundary wall 27 and the upper track 26 to the rear wall 35 and results in the rearwardly stepped guide units as shown.

It is to be understood that while a three track embodiment is disclosed, two and more than three tracks are with the scope of the invention.

The invention claimed is:

1. A work station comprising a platform and spaced legs supporting said platform, multitrack roller guide means mounted on said legs below said platform, and a shelf having a first pair of rollers and a second pair of rollers spaced forwardly of said first pair of rollers for cooperation with said roller guide means to guide movement of said shelf to selected pulled out heights and inclinations, said roller guide means having lower guide tracks and vertically spaced upper guide tracks for guiding said pairs of rollers during forward movement of said shelf to selected pulled out positions and rearward movement to a pushed in storage position, said lower guide tracks defining said pushed in shelf storage position whereat said shelf is spaced below said platform by a distance sufficient to accommodate the height of a machine supported on said shelf, said upper guide tracks each having a first pair of openings and a second pair of openings spaced forwardly of said first pair of openings to allow said first and second pairs of rollers to be moved into said upper guide tracks, said first and second pairs of rollers being spaced from one another a distance less than the distance between said first and second pairs of openings whereby only one pair of rollers at a time can be switched from said lower to said upper guide tracks upon manipulation of said pulled out shelf about the other pair of rollers, thereby to establish a selected height and inclination thereof relative to said platform, and inclines terminating said upper guide tracks, said inclines extending upwardly and forwardly from the rear edges of said pairs of openings to automatically direct pairs of rollers in said upper guide tracks to said lower guide tracks when said shelf is moved rearwardly toward said pushed in storage position.

2. A work station as recited in claim 1, said guide tracks below said pairs of openings in said upper guide tracks having protuberances for signalling movement of said pairs of rollers to track switching positions.

* * * * *